US005388835A

United States Patent [19]

Albright

[11] Patent Number: 5,388,835

[45] Date of Patent: Feb. 14, 1995

[54] BOARD GAME UTILIZING COMBINATION ROLLS OF THREE DICE

[76] Inventor: Kevin Albright, 99 Tapscott St., Brooklyn, N.Y. 11212

[21] Appl. No.: 110,536

[22] Filed: Aug. 23, 1993

[51] Int. Cl.[6] ..... A63F 3/00

[52] U.S. Cl. ..... 273/249

[58] Field of Search ..... 273/242, 243, 248, 249, 273/146

[56] References Cited

U.S. PATENT DOCUMENTS

| | | | |
|---|---|---|---|
| 1,628,073 | 5/1927 | Sousa | 273/146 |
| 1,697,023 | 1/1929 | Rottenburg | 273/146 X |
| 3,463,496 | 8/1969 | Weinstein et al. | 273/146 X |
| 3,560,127 | 2/1971 | Imperato | 273/146 X |
| 4,046,381 | 9/1977 | Comeaux | 273/146 X |
| 4,431,194 | 2/1984 | Lapadura | 273/146 X |
| 4,585,232 | 4/1986 | Sheppard et al. | 273/146 X |
| 5,050,888 | 9/1991 | Schultz et al. | 273/146 X |

FOREIGN PATENT DOCUMENTS

| | | | |
|---|---|---|---|
| 9110488 | 7/1991 | WIPO | 273/146 |

*Primary Examiner*—William E. Stoll
*Attorney, Agent, or Firm*—Natter & Natter

[57] ABSTRACT

A board game having multiple travel paths divided into stations, that combine, separate, recombine and form dual tracks for simultaneously accommodating up to thirty-two game pieces. Each player has four game pieces in game play. Movement of the game pieces are accelerated by combination throws of three game dice. Board indicia control ancillary bonus and/or penalty movement of the game pieces. The board indicia is also indexed to accessory instructional cards and a spinner device having a rotatable pointer for denoting specific instructions controlling game play.

8 Claims, 4 Drawing Sheets

BOARD GAME UTILIZING COMBINATION ROLLS OF THREE DICE

BACKGROUND OF THE INVENTION

1. Field of the Invention

This invention relates generally to amusement devices and especially to a board game having a game piece that moves over a board having plural distinct playing patterns.

In particular, the board game of this invention involves a race to a common finish utilizing numerical combinations from three dice for controlling primary movement of the game pieces.

2. Description of Background Art

Board games that have multiple paths of travel divided into spaces and game pieces assigned to each player for advancement along the spaces by chance controlled apparatus are, for example, disclosed in U.S. Pat. No. 1,695,144 which describes a board game having paths of travel and detours and in U.S. Pat. No. 4,094,510 which shows a game board with dual travel paths. The game disclosed in U.S. Pat. No. 4,279,422 utilizes two separate paths of play and U.S. Pat. No. 4,917,387 discloses a board game having first and second paths that join to form single path. The paths of travel as shown in the aforementioned patents however do not combine, separate, recombine and form parallel travel paths as in the present invention to provide alternative routes of travel and more challenging playing patterns.

Another deficiency of many of the previously described board games is that a relatively prolonged timeframe for game play is required and the players frequently lose interest before completion of the game. The previous game apparatus did not employ three dice and combination rolls for accelerating advancement of the game pieces along the travel paths. Although a board game that utilizes three dice is shown in U.S. Pat. No. 4,895,374, that game is directed to teaching music and has only two number cubes and a letter cube representing musical letters.

With regard to board games that hold the players interest by incorporating themes or are otherwise intended to simulate a particular activity, such games are representatively shown in U.S. Pat. No. 3,977,680 which describes a board game apparatus having a criminal justice theme; U.S. Pat. No. 4,087,094 which shows a board game having a travel course that simulates vehicle traffic; U.S. Pat. No. 4,121,823 which relates to a board game for teaching religious subject matter; and U.S. Pat. No. 4,932,667 which discusses a performing artist board game that uses a single die and other chance devices.

These board games however, have not approached socio-economic problems in a manner as in the instant board game wherein the game participants are subliminally reminded to remain in school, to attend college and to be moral and law abiding citizens. Thus the board game of the present invention not only holds and maintains the interest of the players by providing a challenging and competitive game but also and indirectly imparts socio/educative values. The board game additionally requires the players to exercise their mental faculties to initiate game strategy and to adapt interpersonal skills by cooperating with fellow players in a teamwork effort during game play.

SUMMARY OF THE INVENTION

Briefly, the nature of this invention concerns a board game wherein each player is assigned four game pieces that are advanced from separate starting areas along alternative circuitous paths of travel, marked in steps or stations.

The primary movement of the playing pieces are controlled by the throw or roll of game dice. The game play time is accelerated by use of three dice which are simultaneously rolled and the game piece is moved a consecutive number of stations corresponding to the sum of the numbers appearing on the faces of the three dice. The player is entitled to additional bonus rolls if duplicate numbers appear on the faces of two or three of the first three dice as rolled.

The movement of the game pieces are further controlled by ancillary chance devices including a spinner and also by a selected number of stations which contain indicia providing specific instructions which effect the game play. Some of the indicia are keyed to the spinner which can be incorporated onto the game board. The forward or retrograde movement of the game piece is also determined in accordance with instructions on mission cards. The stations include indicia directing the player whose game piece lands on the station, to select a mission card. Several of the mission cards and many of the stations contain indicia suggesting the benefits of education that is correlated to "forward" movement of the game piece. The mission cards associated with criminal behavior require the player to go "on trial" and are associated with "backward" or delayed movement of the game piece.

In view of the foregoing it should be apparent that the present invention provides a new and improved board game.

Having thus summarized the invention, it would be seen it is an object of the invention to provide a board game of the general character described herein which is not subject to the shortcomings of the previously described board games.

Another object of the invention is to provide a board game that is both entertaining and mentally stimulating.

It is another object of the present invention to provide a board game which may be easily and efficiently manufactured and marketed.

A further object of the present invention is provide a board game utilizing multiple chance devices for controlling movement of game pieces.

A still further object of this invention is to provide a board game in which each player has multiple game pieces simultaneously in play.

Yet another object of this game is to utilize combination rolls of three dice for accelerating advancement of the game piece.

Other objects in this invention will in part be apparent and in part will be pointed our herein after.

With these ends in view, the invention finds embodiment in certain combinations of elements and arrangements of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which is shown an exemplary embodiment of the invention.

DETAILED DESCRIPTION OF THE INVENTION

Figure 1:
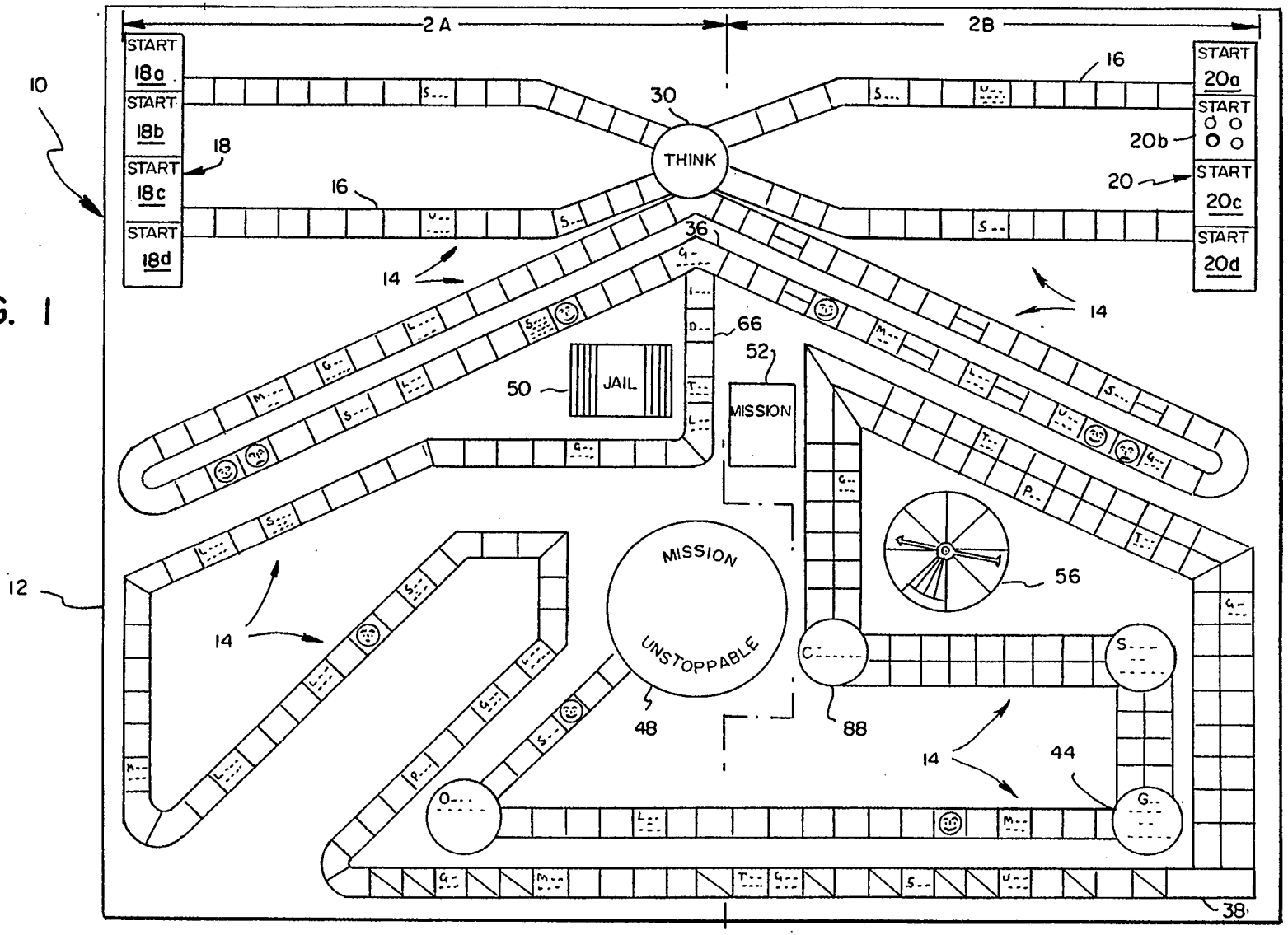
FIG. 1 is a top plan overall view of the game board according to the present invention showing a plurality of distinct playing patterns.
Figure 2A:
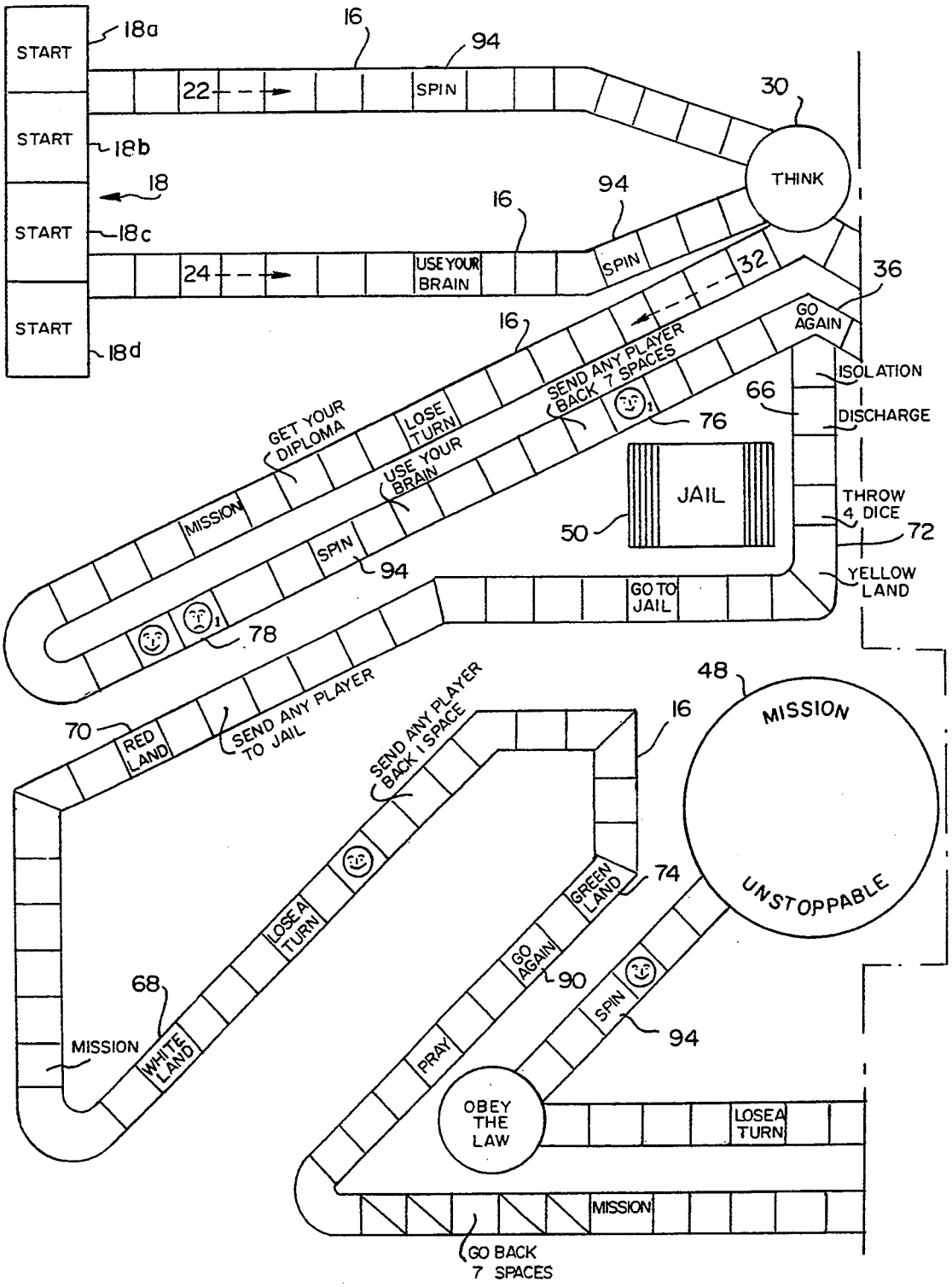
FIGS. 2A and 2B each show a top plan view in detail of substantially one-half portions of the game board corresponding to the respective portions as designated in FIG. 1.
Figure 2B:
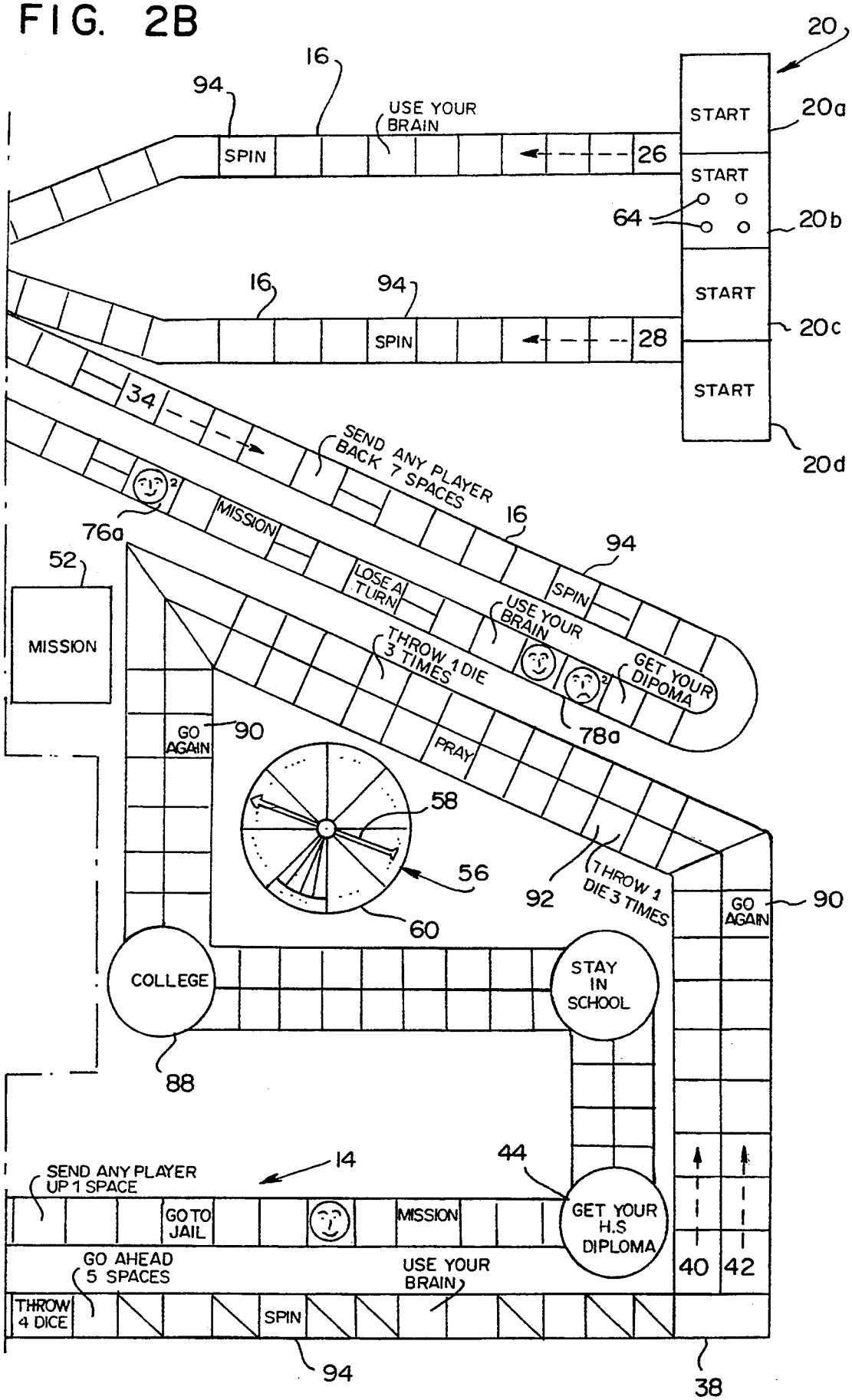

Referring now in detail to the drawings, reference numeral 10 denotes generally a board game apparatus in accordance with this invention. The game apparatus 10 as illustrated in the embodiment of FIG. 1, includes a game board 12 with a smooth planar surface having a pattern on one face thereof which defines a plurality of travel paths 14. The travel paths 14 are marked off in steps or stations 16. The board 12 also contains two starting areas 18, 20. Each of the starting areas 18, 20 is divided into four segments designated **18*a*–18*d*, and 20*a*–20*b*. The players are each assigned a starting segment. Multiple travel paths 22, 24, 26 and 28 are connected to the respective starting areas 18, 20. The travel paths 22, 24, 26, 28 meet at a common station 30, denoted "think". The travel path is then bifurcated to form two branch travel paths 32, 34 that are rejoined at a station 36 denoted "go again". Each of the travel paths 22, 24, 26, 28 and each of the branch travel paths 32, 34 contain an equivalent number of stations 16. The travel path 14 then follows a circuitous route until reaching a junction station 38. Thereafter, the travel path 14 is divided into two parallel tracks 40, 42 until reaching a station 44 denoted "get your high school diploma". A single travel path 14 follows thereafter and terminates at a goal 48** denoted Mission Unstoppable.

Figure 7:
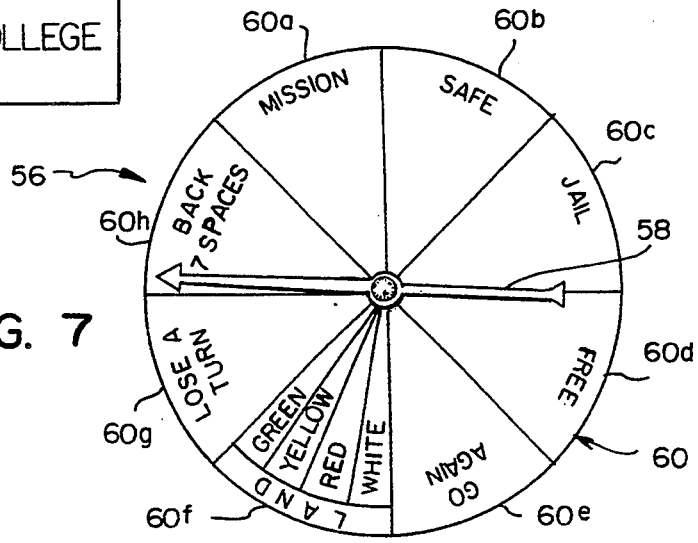
FIG. 7 is a plan view of the spinner chance device showing a pointer rotatably mounted above a circular field divided into sectors containing instructions affecting game play.

The game board 12 also defines an area 50 designated "jail" and a space 52 marked "mission" for the placement of a stack of playing cards 54. In addition, a spinner device 56 is incorporated on the game board 12 or alternatively, can be provided as an accessory component. The spinner device 56, as shown in FIG. 7, includes a pointer 58 rotatably mounted above a circular field 60 that is divided into eight sectors **60*a*–60*h*** as will be further discussed hereinafter.

Figure 5:
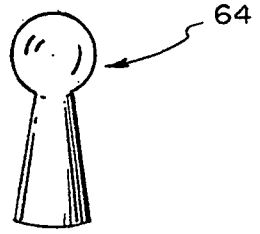
FIG. 5 is a perspective view of a representative game piece.
Figure 4:
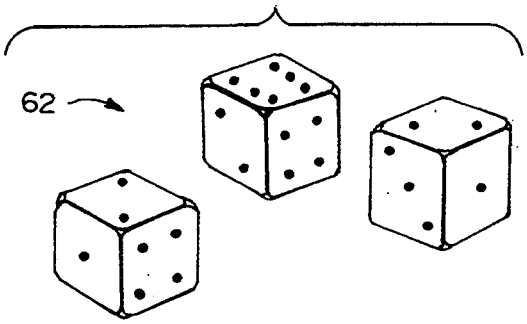
FIG. 4 is a perspective view of a three game dice utilized during play of the board game.

The game apparatus also includes a plurality of game dice 62 as shown in FIG. 4, and accompanying game pieces 64. The game pieces 64 are substantially conically shaped and have a spherical head, as typically shown in FIG. 5. A total of thirty-two game pieces 64 in eight different colorations are employed and are used in matching color sets of four.

Further with regard to the stations 16, it should be noted that indicia and/or colorations appear in selected stations 16 and are related to the game play as will be further explained hereinafter. Other markings appearing in the stations 16, which do not influence movement of the game pieces 64, are as follows: "Stay in School", "Think", "Pray", "Use your brain" and "Obey the law". The foregoing wording is intended to indirectly reinforce a socio/educative message.

Figure 3:
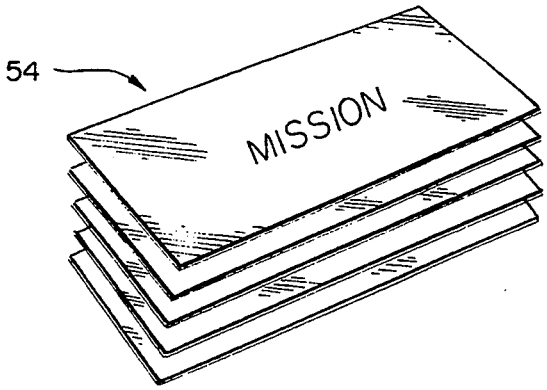
FIG. 3 is a perspective view of a stack of mission cards utilized during game play.
Figure 6:
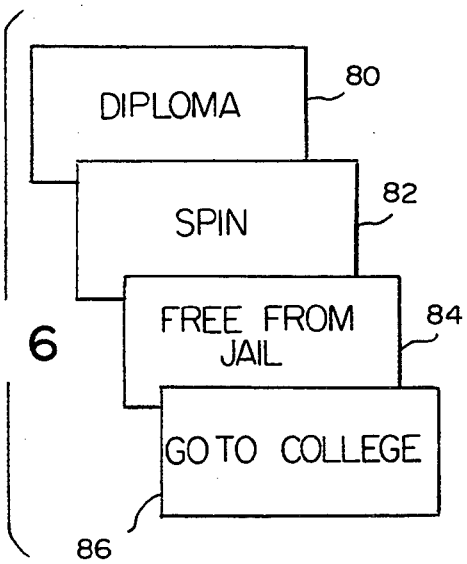
FIG. 6 is a plan view illustrating some of the indicia appearing on the mission cards.

The game board 12 is preferably fabricated from a stiff paperboard, pasteboard, cardboard or like material which has been laminated as with a transparent plastic film to provide a durable playing surface. A flexible hinge section (not shown) can also be provided transversely through the board 12 so as to permit folding for compact storage within a box when not in use. The playing pieces 64 are comprised of wood or plastic material being of compatible size for placement on the stations 16 and within the starting areas 18, 20 as typically shown in segment **20*b*. The playing cards 54 are stackable as shown in FIG. 3 and placed within the "mission" space 52 on the board 12 for use during game play. Each of the cards 54 has instructional material or messages on one face thereof that is not visible to the player until one of the selected cards 54 is turned over. In FIG. 6, there is representatively shown a "Diploma" card 80, a "Spin" card 82, a "Free from jail" card 84 and a "Go to College" card 86**.

With regard to the messages, the mission cards 54 fall within two principal groupings, namely, "location" cards and "penalty" cards. In addition, there are four "Spin" cards 82 which when selected, direct the player to spin the rotatable pointer 58. The player must then follow the instructions that register with the pointer 58 when it comes to rest. A player must also spin the pointer 58 when the game piece lands in a station 94 marked "Spin". The "location" cards include the following instructions:

advance three spaces;
go to nearest "white land" station;
go to nearest "green land" station;
go to nearest "red land" station;
go to nearest "yellow land" station;
go to happy face #1;
go to happy face #2;
go to sad face #1;
go to sad face #2;
go to college;
go directly to jail;
go directly to finish;
go again;
go to isolation station;
go to college;
go forward ten spaces;
go back to starting area;
go directly to station ahead of player in first position; if no one is in front of you, remain where you are;
go directly to station behind player in last position; if no one is behind you, remain where you are;
go back ten stations;
go again; and
free from jail.

The "penalty" cards, include the following:

(a) you are accused of "shoplifting", you must go on trial;
(b) you have been accused of "mugging", you must go on trial;
(c) you have been accused of "car theft", you must go on trial; and
(d) you have been accused of "bank robbery", you must go on trial.

In connection with the foregoing "penalty cards", one of the following penalties will apply:

(1) Go to jail,
(2) Go back twenty-five spaces,
(3) Lose three turns,
(4) Throw three dice three times and move game piece backwards in accordance with the cumulative total of numerical count on the dice.

In order to determine which of the above noted penalties are to be enforced, the player must throw one die and the number between one and four that appears on the die is the penalty that is to be enforced. If the number appears is "five" or "six" the die is rolled again until a number appears between one and four.

Additional mission cards 54 include the following instructions:
lose a turn;
send any player to jail; and
send any player back two stations.

If a player is sent "to jail" but has previously selected and is still holding the "free from jail" card 84 he may return the card to the stack of cards 54 and move the game piece 64 from the jail area 50 to a "discharge" station 66 on the next turn.

Two of the mission cards 54 are marked "blank" and do not require any action when selected. The "diploma" cards 80 are four in number and are set aside from the rest of the cards 54 and acquired by a player upon landing on a station 44 marked "get your H.S. diploma". The "diploma" card 80 is held by the player until needed i.e. when the player is instructed to "go to college" he must have the "diploma" card before he can advance to a station 88 denoted "College".

General Rules of Play

The game is intended for play by from two (2) to eight (8) participants. This will comfortably permit the players to position themselves around the board 12. The object of the game is to be the first player to move his/her four (4) game pieces 64 from the starting areas 18, 20 to the goal 48 following the travel paths 14.

To start the game, each player rolls two of the game dice 64; the player with the highest number goes first. In the case of the a tie, the players involved in the tie roll again until one player is successful. The order of play will then continue from player to player moving in a clockwise direction from the player receiving the highest number. Each player selects, in order, four game pieces 64 having the same color and places the game pieces 64 in one of the corresponding color-coded starting segments 18*a*–18*d*, 20*a*–20*d*.

The movement of the respective game pieces 64 over the board 12 on the stations 16 is determined by numerical combinations from the throw or roll of three dice 62 or equivalent number cubes, as determined by the spots appearing on the upturned faces of the dice 62. Before rolling the dice 62, the players must denote one of the four game pieces 64 that he/she intends to move. If on the first roll the same number of spots appears on the upturned faces of all three dice 62, that player is permitted to again roll the three dice, followed by a roll of two dice, followed by a roll of one die and may move his game piece 64, sequentially after each roll, a total number of stations 16, corresponding to the cumulative sum of the numerical count appearing on the total nine dice as rolled. If however, on the initial roll, the identical count appears on only two of the three dice, that player may again roll however, only two dice followed by a roll of one die and moves his game piece a total number of spaces 16 corresponding to the cumulative total of the numerical count of the six dice thrown. It should be noted that the game piece 64 is moved after each roll of the dice and that instructions on stations 16 must be followed and may cancel the remaining rolls of the dice as will be discussed hereinafter.

If during game play the game piece 64 lands on a station 90 marked "go again", that player receives an additional turn and rolls three dice, but does not qualify for combination rolls even if there is a triple or double occurrence of the same number. If a game piece 64 lands on a station 92 marked "throw one die three times" the instructions are followed explicitly however if the game piece 64 after having been moved the cumulative sum of the number count appearing on the three dice, lands on the station 90 marked "go again" the player does not go again.

When a game piece 64 lands on the station 94 marked "spin" the player must spin the rotatable pointer 58 on the spinner device 60. If the pointer 58 lands in a sector 60*b* marked "safe" the player neither receives a bonus nor a penalty. If the pointer 58 registers with a sector 60*c* marked "go to jail" he must remove his game piece 64 and place it in the jail area 50 and can not move that game piece 64 until it is discharged from "jail". If the pointer 58 stops in a sector 60*d* marked "free" the game piece 64 may be removed from the jail area 50 and reinserted into the travel path 14 by placement in the station 66 designated "discharge". If the pointer 58 registers with a sector 60*e* "go again" the player may throw the three die for an additional turn without the availability of any combination rolls. If the pointer 58 stops in a sector 60*f* marked "land", this sector is subdivided into four segments marked "white", "red", "yellow" and "green". The player may move his game piece 64 to a corresponding color-coded station marked "white land" 68, "red land" 70, "yellow land" 72 or "green land" 74. If the pointer 58 comes to rest in a sector 60*g* denoted "lose a turn" the player loses his next turn to roll and if the pointer lands in a sector 60*h* marked "move back seven spaces" the game piece 64 must be moved back as directed. Another sector 60*a* designated "mission" requires the player to select the upper most mission card and to follow the instructions thereon.

When a game piece lands on a station 16 occupied by an opposing player's game piece, the game piece in motion must be moved back five stations. If the final station is marked "Spin", "Go Again" or "Mission", these instructions are disregarded. If however the game piece in motion arrives at an occupied station during any combination roll of the dice, then the player must throw two dice and move back a number of stations equal to the sum of the numbers appearing on the two dice. The player may then continue in a forward direction with the remaining rolls of the dice still available.

If during the course of play a player does not designate which game piece is to be moved prior to rolling the dice the player's turn is forfeited.

A player after reaching station 30, may select either of the travel paths 32, 34. Similarly at station 38 the player may follow either path 40 or 42. It should also be noted that the symbols at a station 76, 76*a*, denote "happy face 1" and "happy face 2" respectively and the symbols at a station 78, 78*a* represents "sad face 1" and "sad face 2" respectively. These symbols 76, 76*a*, 78, 78*a* are keyed to the indicia on the mission cards 54. The other indicia on the stations 16 is self explanatory.

It should thus be seen that there is thus provided a board game utilizing combination throws of three game dice which achieves the various objects of this invention and which is well adapted to meet conditions of practical use.

Since various possible embodiments might be made of the present invention or modification might be made to the exemplary embodiments above set forth, it is to be understood that all materials shown and described in the accompanying drawings are to be interpreted as illustrative and not in a limiting sense.

Having thus described the invention, there is claimed as new and desired to be secured by Letters Patent:

1. A method for playing a board game utilizing combination rolls of three dice for determining primary movement of a playing piece on a game board and ancillary chance means for controlling secondary movement of the playing piece, said method comprising the steps of:

providing a game board having a plurality of travel paths divided into stations including a starting area and a common goal;

selecting one or more identical game pieces for placement in the starting area;

rolling at least three game dice by each of the players;

advancing each player's game piece sequentially in a forward direction a number of stations corresponding to the sum of the numerical count indicated on an upturned face of each of the three game dice;

rolling the three game dice for a second roll upon the occurrence of an identical numerical count on the respective upturned face of each of the three game dice of the first roll and further advancing the game piece a number of stations corresponding to the cumulative numerical count appearing on the respective upturned faces of the three game dice;

rolling two game dice for a third roll and advancing the game piece a number of stations corresponding to the cumulative numerical count appearing on the respective upturned faces of the two game dice; and rolling one game die for a fourth roll and advancing the game piece a number of stations corresponding to the numerical count appearing on the upturned face of the game die.

2. A method of playing a board game as claimed in claim 1 including the steps of:

rolling two game dice for a second roll when an identical numerical count appears on the respective upturned faces of two of the three game dice on the first roll and advancing the game piece a number of stations corresponding to the cumulative numerical count appearing on the respective upturned faces of the two game dice; and rolling one game die for a third roll and advancing the game piece a number of stations corresponding to the numerical count appearing on the upturned face of the game die.

3. A method of playing a board game as claimed in claim 2 further including the step of:

following instructive indicia on a station occupied by a player's game piece to access the ancillary chance means.

4. A method of playing a board game as claimed in claim 3 wherein the ancillary chance means comprises a spinner device including a pointer rotatably mounted above a field containing indicia affecting game play and further including the steps of:

rotating the pointer mounted on the spinner device as instructed by station indicia; and following indicia indexed by the pointer after it comes to a rest position.

5. A method of playing a board game as claimed in claim 3 wherein the ancillary chance means comprises a plurality of mission cards, said mission cards including an instructional message on one face thereof wherein the cards are stacked with the message being concealed from view, further including the steps of:

selecting a card to reveal a message; and integrating the message contained on the card into the game play.

6. A method for playing a board game as claimed in claim 1 further including the step of:

selecting four game pieces for placement in the starting area.

7. A method of playing a board game is claimed in claim 6 further including the step of:

denoting one of the player's game pieces for movement prior to rolling the game dice.

8. A method of playing a board game as claimed in claim 1 further including the step of:

moving a game piece a predetermined number of stations in a backward direction along the travel path when the game piece lands on a station occupied by an opposing player's game piece.

* * * * *